United States Patent [19]

Ishida

[11] Patent Number: 4,464,966

[45] Date of Patent: Aug. 14, 1984

[54] RHYTHM DATA SETTING SYSTEM FOR AN ELECTRONIC MUSICAL INSTRUMENT

[75] Inventor: Hideaki Ishida, Tokyo, Japan

[73] Assignee: Casio Computer Co., Ltd., Tokyo, Japan

[21] Appl. No.: 382,931

[22] Filed: May 28, 1982

[30] Foreign Application Priority Data

Jun. 5, 1981 [JP] Japan ..... 56-85650

[51] Int. Cl.[3] ..... G10H 1/40; G10H 3/06; G10H 7/00

[52] U.S. Cl. ..... 84/1.03; 84/1.18; 84/1.28; 84/483 A; 84/DIG. 12

[58] Field of Search ..... 84/1.03, 1.18, 1.28, 84/DIG. 12, 483 R, 483 A

[56] References Cited

U.S. PATENT DOCUMENTS 4,256,005 3/1981 Mishima ..... 84/1.03

4,261,241 4/1981 Gould et al. ..... 84/1.18

4,344,345 8/1982 Sano ..... 84/1.03

4,422,361 12/1983 Ishii et al. ..... 84/1.18

OTHER PUBLICATIONS

*Journal of the Patent Office Society*, Exoparte S (Board of Appeals) Aug. 4, 1943 (Case No. 109).

*Primary Examiner*—S. J. Witkowski

*Attorney, Agent, or Firm*—Frishauf, Holtz, Goodman & Woodward

[57] ABSTRACT

Bar codes representing rhythm data corresponding to rhythm pattern, rhythm progression or a certain kind of rhythm are printed in relation to a musical score, and are read out by scanning with a bar code reader. The rhythm data thus read out are stored in RAMs under the control of a CPU. The rhythm data stored in the RAMs are read out by the CPU and supplied through an amplifier to a loudspeaker, for producing sounds.

17 Claims, 13 Drawing Figures

FIG. 4

| FUNCTION CODE | CODE |
|---|---|
| DUMMY | 0 0 0 0 |
| START MARK | 0 0 1 0 |
| RHYTHM DESIGNATION | 0 0 0 0 |
| END MARK | 1 1 1 1 |
| CONT. MARK | 0 |
| TERMINATION MARK | 1 |

FIG. 5

| RHYTHM | CODE |
|---|---|
| ROCK | 1 0 1 1 |
| WALTZ | 1 0 1 0 |
| MAMBO | 1 0 0 1 |
| MARCH | 1 0 0 0 |
| RUMBA | 0 1 1 1 |
| NORMAL | 0 0 0 0 |
| VARIATION | 0 0 0 1 |

FIG. 6

| TEMPO DESIGNATION | CODE |
|---|---|
| 𝅘𝅥𝅯 = | 0 1 0 1 |
| ♪ = | 0 1 0 0 |
| ♪. = | 0 0 1 1 |
| ♩ = | 0 0 1 0 |
| ♩. = | 0 0 0 1 |
| 𝅗𝅥 = | 0 0 0 0 |

FIG. 7

| NUMBER OF STEPS OF FILL-IN | CODE |
|---|---|
| 4 | 0 0 0 1 |
| 8 | 0 0 1 0 |
| 12 | 0 0 1 1 |
| 16 | 0 1 0 0 |
| END OF FILL-IN | 0 0 0 0 |

FIG. 8

| FILL-IN NUMBER | CODE |
|---|---|
| FILL-IN 1 | 0 0 1 0 |
| FILL-IN 2 | 0 0 1 1 |

FIG. 9

FILL-IN 1

| | RHYTHM STEP | | | | | | | |
|---|---|---|---|---|---|---|---|---|
| | 1 | 2 | 3 | 4 | 5 | 6 | 7 | 8 |
| TAM TAM | | | | | | | | |
| H C | | | | | O | O | | |
| L C | | | | | | | O | O |
| C L | | | | | | | | |
| CYM | | | | | | | | |
| H H | | | | | | | | |
| S D | | | O | | | | | |
| B D | O | | | | | | | |

FIG. 10

FILL-IN 2

| | RHYTHM STEP | | | | | | | |
|---|---|---|---|---|---|---|---|---|
| | 1 | 2 | 3 | 4 | 5 | 6 | 7 | 8 |
| TAM TAM | | | | | O | O | | |
| H C | | | O | O | | | | |
| L C | O | O | | | | | | |
| C L | | | | | | | | |
| CYM | | | | | | | O | |
| H H | | | | | | | | |
| S D | | | | | | | | |
| B D | O | | | | | | | |

FIG. 13

| | RHYTHM STEP | | | | | | | |
|---|---|---|---|---|---|---|---|---|
| | 1 | 2 | 3 | 4 | 5 | 6 | 7 | 8 |
| TAM TAM | | | | | | | | |
| H C | | | | | | | | |
| L C | | | | | | | | |
| C L | | | | | | | | |
| CYM | | | | | | | | |
| H H | O | O | O | O | O | O | O | O |
| S D | | | O | | | | O | |
| B D | O | | | O | O | | | O |

FIG. 11

0000 (1) 0010 (2) 0000 (3) 1011 (4) 0010 (5) 00000110010 (6) 0010 (7) 00000001 (8) 00000000 (9) 00000010 (10) 00000000 (11)

01000000 (12) 01000000 (13) 00100000 (14) 00100000 (15) 0010 (16) 00100001 (17) 00100000 (18) 01000000 (19) 1111 (20) 0 (21) 1110 (22)

0000 (23) 0010 (24) 01000000 (25) 10000000 (26) 10000000 (27) 00001000 (28) 00000000 (29) 0000 (30) 0000 (31) 0100 (32) 0010 (33) 0000 (34)

0100 (35) 0010 (36) 0001 (37) 1000 (38) 0011 (39) 0000 (40) 0100 (41) 0011 (42) 1111 (43) 1 (44) 0011 (45)

RHYTHM DATA SETTING SYSTEM FOR AN ELECTRONIC MUSICAL INSTRUMENT

BACKGROUND OF THE INVENTION

This invention relates to rhythm data setting systems for setting rhythm data representing, for example, a rhythm pattern, rhythm progress or kind of rhythm, in an electronic musical instrument capable of rhythm performance.

In most prior art electronic musical instruments capable of rhythm performance, such as an automatic rhythm performance device like a rhythm box, the rhythm data representing a rhythm pattern, kind of rhythm, etc., are stored permanently. Recently, however, devices in which rhythm data can be freely set by the user are also in practical use. In this case, the rhythm data is set by button operation. This data input operation, however, is considerably complicated, causing beginners to input data erroneously as well as requiring a great deal of time for inputting data. Accordingly, it has been contemplated to input rhythm data by using a magnetic tape, a magnetic card or the like in which necessary rhythm data is previously stored. However, such a data recording medium is expensive and generally has small storage capacity. Therefore, the quantity of data that can be inputted inexpensively is limited.

SUMMARY OF THE INVENTION

An object of the invention is to provide a rhythm data setting system for an electronic musical instrument, which is inexpensive and permits a great quantity of rhythm data to be readily stored.

According to the invention, this object is attained by a rhythm data setting system, in which rhythm data to be set is read out from a medium on which predetermined rhythm data is recorded in the form of bar codes, by using a bar code reader for reading out bar code, and the readout data is written in a memory.

BRIEF DESCRIPTION OF THE DRAWINGS

FIGS. 4 to 8 are bit configuration tables for various data codes used in the embodiment;

FIGS. 9 and 10 are views showing respective fill-in rhythm pattern contents;

FIG. 11 is a view representing the rhythm progress pattern of the musical score shown in FIG. 12 in terms of the codes shown in FIGS. 4 to 10;

FIG. 13 is a view representing a rock rhythm pattern.

DETAILED DESCRIPTION OF THE PREFERRED EMBODIMENTS

Figure 1:
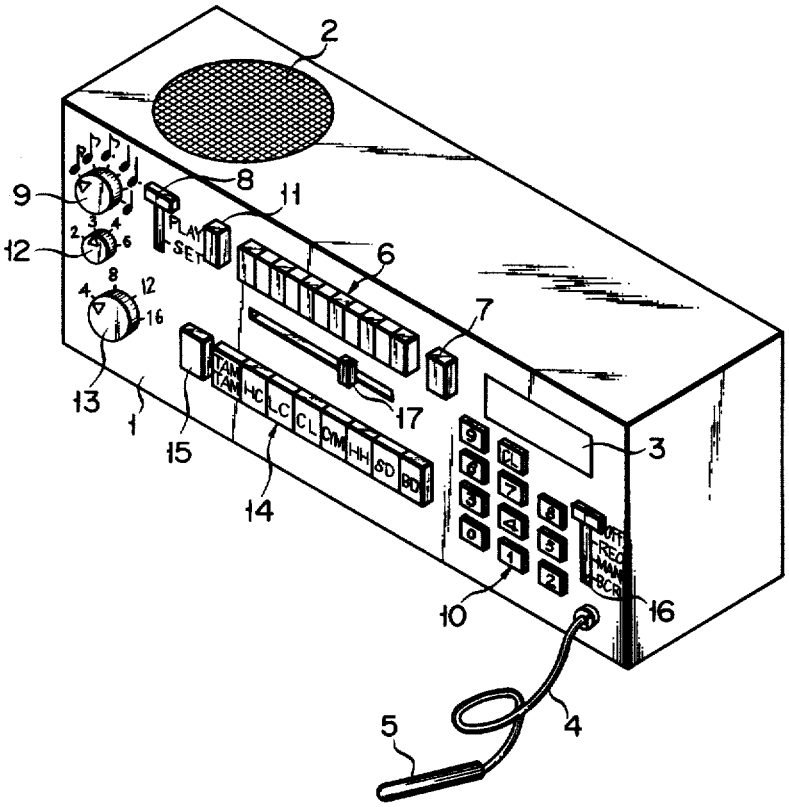
FIG. 1 is a perspective view showing a rhythm box provided with a bar code reader as one embodiment of the invention.

An embodiment of the invention will now be described with reference to the drawings. FIG. 1 shows the outer view of a rhythm box embodying the invention. The body of the rhythm box includes an operating section 1, a loudspeaker 2 as a sound producing section and a display section 3. Further, a bar code reader (or hand scanner) 5 is connected to the body via a chord 4. LSI parts constituting an electric circuit shown in FIG. 3, and the loudspeaker 2 are accommodated in the rhythm box body. Various switches 6 to 17 are provided in the operating section 1. The switches 6 are provided for selecting corresponding ones of eleven different rhythms. The switch 7 is a variation switch for providing variation to the selected rhythm. The switches 8 to 12 are used when setting a rhythm tempo. The switch 8 is a first mode switch having a "PLAY" mode position and a "SET" mode position. At the time of setting a tempo, the switch 8 is set to the "SET" position. When setting, for instance, the tempo ♩=(72), the switch 9 is first set to the ♩ position, and then after inputting "72" with the ten-key set 10 the switch 11 is operated, whereby desired tempo data can be written in a predetermined memory. The switch 12 is provided for setting the beat number. The switch 13 is provided for specifying the number of sections into which one measure is divided when setting fill-in data. Switches 14 are provided for selecting various percussion instrument sounds, namely of the tam-tam (TAM TAM), high conga (HC), low conga (LC), claves (CL), cymbal (CYM), high-hat (HH), snare drum (SD) and bass drum (BD). A switch 15 is provided for writing the selected percussion instrument sound in a predetermined memory. A switch 16 is a second mode switch. It has "OFF," "REC," "MAN" and "BCR" positions for specifying an "OFF" mode, a recording mode, a manual mode and bar code reading mode (in which the bar code reader 5 is rendered operative), respectively. A switch 17 is a volume switch.

Figure 2:
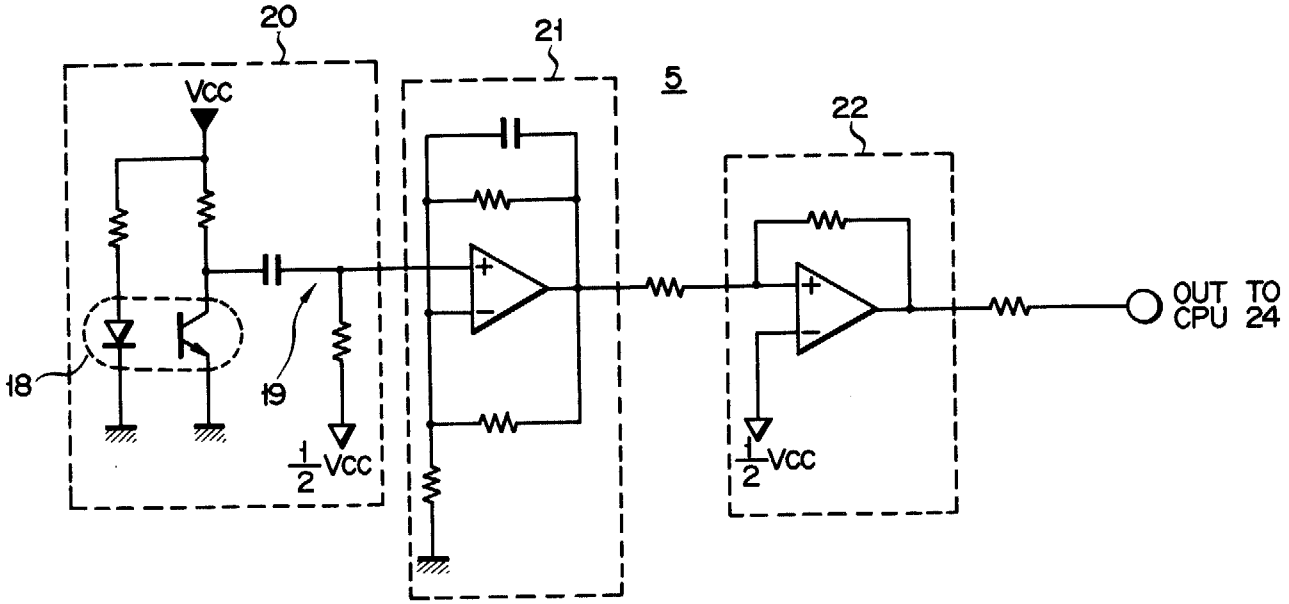
FIG. 2 is a circuit diagram of the bar code reader.

The bar code reader 5 has a circuit construction as shown in FIG. 2. At the tip of the bar code reader 5, there is provided a photoreflector 18 which includes light-emitting and light-receiving elements for converting the reflectivity of light from a bar code into a corresponding electric signal (magnitude of current). The output of the photoreflector 18 is differentiated in a differentiating circuit 19. The differential output is provided as the output of a photoelectric converter 20. This output is amplified by an AC amplifier 21, the output of which is supplied to a voltage comparator 22. The voltage comparator 22 includes an operational amplifier which compares the output of the AC amplifier 21 with a reference level ½ Vcc. The operational amplifier output is supplied from an output terminal OUT to a CPU 24 to be described later for conversion into a logic signal there.

Figure 3:
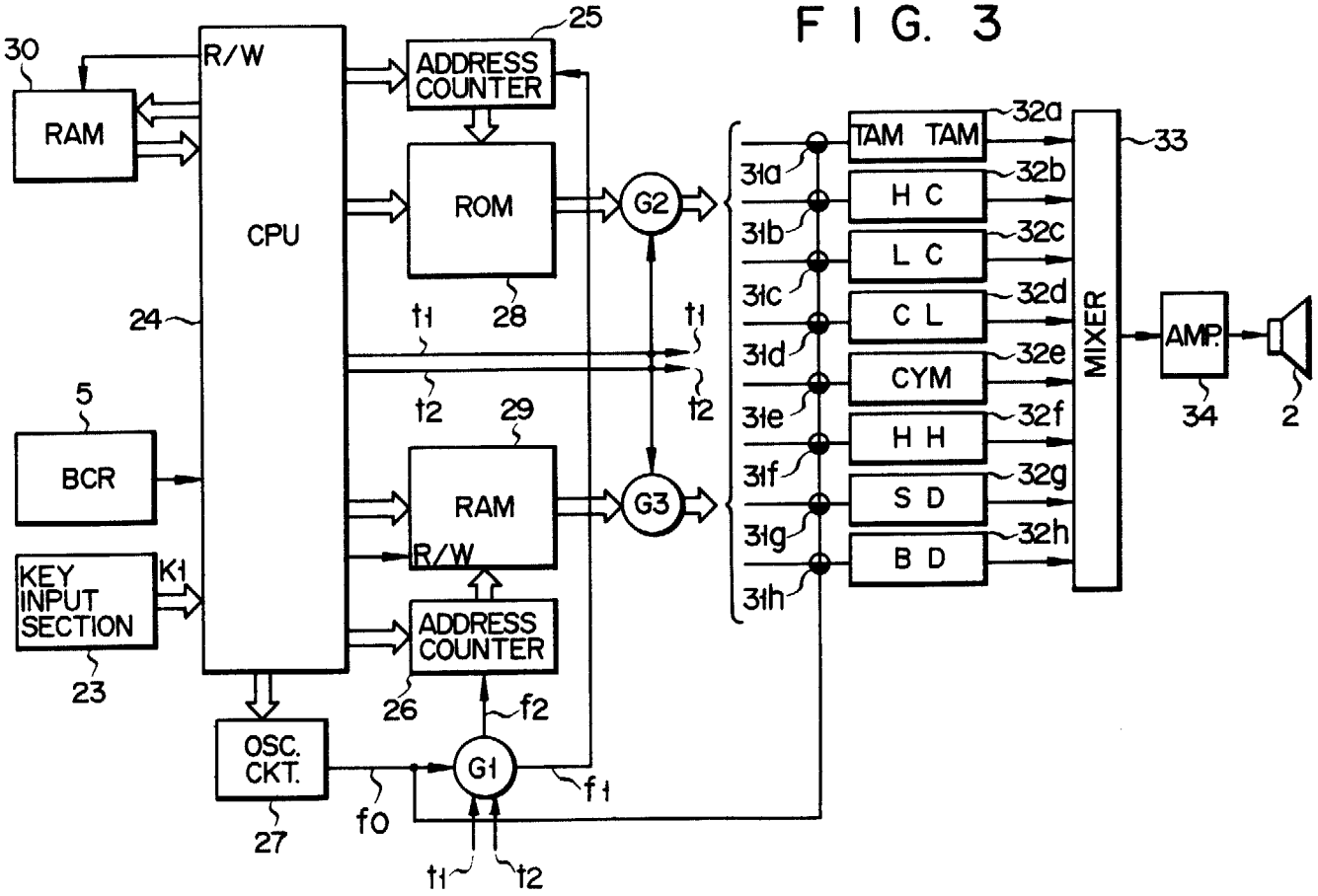
FIG. 3 is a block diagram showing the circuitry of the embodiment of FIG. 1.

The circuit construction of the rhythm box shown in FIG. 1 will now be described with reference to FIG. 3. When the keys 6 to 17 in the operating section 1 are selectively operated, a key input signal KI corresponding to the operated switch is provided from a key input section 23. This key input signal KI and also bar code data read out by the bar code reader 5 are supplied to the CPU 24. The CPU 24 controls all the operations of the rhythm box. The beat number and number of divided sections, these being specified by operation of the switches 12 and 13, are preset in address counters 25 and 26 for control of the number of the counting steps thereof. The CPU 24 further controls the oscillation frequency of an oscillator circuit 27 according to the rhythm tempo. The oscillator circuit 27 generates a clock signal $f_0$ corresponding to the normal rhythm and fill-in variation rhythm. The clock signal $f_0$ is supplied to the address counters 25 and 26 through a gate G1, which is controlled by control signals $t_1$ and $t_2$ to be described later. The signals $f_1$ and $f_2$ from the gate G1 control the progress of the content of the address counters 25 and 26; that is, the address counters 25 and 26 are caused to effect counting operation according to a speed corresponding to the frequency of the signals.

The address counter 25 produces address data specifying an address of a ROM 28. The ROM 28 is a memory, in which rhythm pattern data for eight different rhythm sounds, namely tam-tam, high conga, low conga, claves, cymbal, high-hat, snare drum and bass drum, are stored according to various rhythms such as waltz and rock. The CPU 24 specifies memory areas for various rhythms in the ROM 28, and the output of the address counter 25 specifies a rhythm pattern data address in each area in response to the operated switch 6.

The address counter 26 produces address data specifying an address in a RAM 29. The RAM 29 is a memory, in which the fill-in data provided from the CPU 24, i.e., externally provided rhythm pattern data, is stored. The RAM 29 is set to a read or write mode according to a read/write signal R/W from the CPU 24, and its address is specified by the address data from the address counter 26. When the RAM 29 is set to the write mode, fill-in data provided from the CPU 24 is written in the RAM 29.

The CPU 24 further provides a read/write signal R/W to a RAM 30. The RAM 30 is a memory for storing the content of each measure of the music score. Data transfer between the RAM 30 and CPU 24 is effected according to the signal R/W.

Each rhythm pattern data read out from the ROM 28 is supplied to a gate G2 which is on-off controlled according to the control signal $t_1$ provided from the CPU 24. The output of the gate G2 is supplied as operation instructing signals to rhythm sound sources 32*a* to 32*h* through respective switching gates 31*a* to 31*h*. Rhythm sound signals which are generated when the rhythm sound sources 32*a* to 32*h* are driven, are mixed in a mixer 33. The output of the mixer 33 is coupled through an amplifier 34 to the loudspeaker 2 for sound production.

Each rhythm pattern data read out from the RAM 29 is supplied to a gate G3 which is on-off controlled according to the control signal $t_2$ provided from the CPU 24. The output of the gate G3 is coupled to the switching gates 31*a* to 31*h* for sound production from the loudspeaker 2.

The switching gates 31*a* to 31*h* are simultaneously on-off controlled according to the clock signal $f_0$. In the case when rhythm pattern data of logic level "1" appears in succession, these switching gates permit the distinguishing of data (for the same rhythm sound) in terms of the "1" and "0" states of the clock signal $f_0$.

Figure 12:
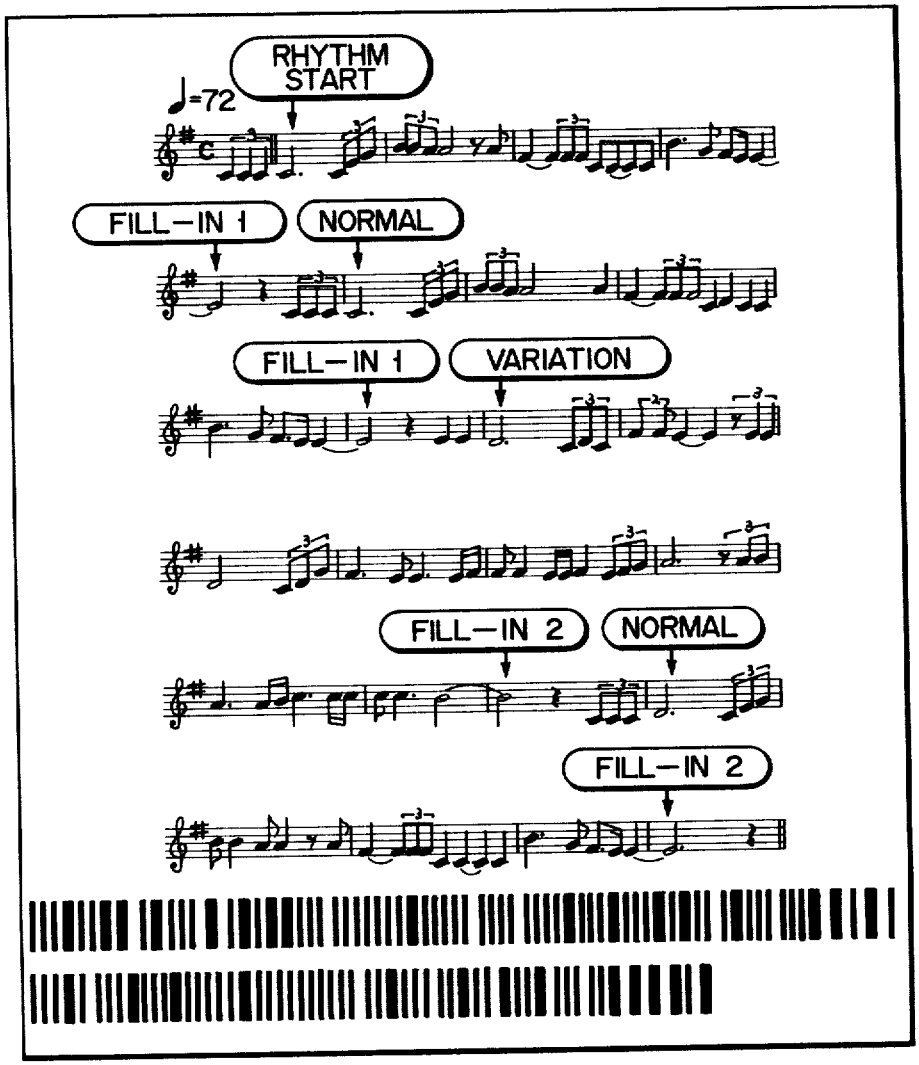
FIG. 12 is a view showing the musical score.

The operation of this embodiment will now be described with reference to FIGS. 4 through 12. Suppose now the case of writing rhythm data in the RAMs 29 and 30 by using the bar code reader 5. The rhythm data shown in the score of FIG. 12 is to be written in the RAMs 29 and 30. The mode switch 8 in FIG. 1 is first set to the "SET" position. At this time, the CPU 24 effects control with respect to this mode according to an output signal from the first mode switch 8. Thus, the RAMs 29 and 30 receive the R/W control signal and are rendered to be ready for writing. Next, the second mode switch 16 is set to the "BCR" position, whereby the bar code reader 5 is rendered operative.

In this state, the bar codes as shown in FIG. 12 below the music score are scanned from left to right. As a result, signals of logic values "1" and "0" are stored in the RAMs 29 and 30 according to the width of the bar codes, irrespective of whether they are white or black.

FIG. 11 shows binary data obtained by conversion of the bar codes shown in FIG. 12. This binary data constitutes the bar code data read out by the bar code reader 5. In FIG. 11, four lines of data array correspond to two lines of the bar code. Thus, each array consisting of two sublines of data correspond to one line of bar codes. The first areas (1) and (23) in the individual lines in FIG. 11 are dummy areas (see the function codes of FIG. 4). The dummy areas are provided for setting a reference "0" level by judging the speed of scanning of the bar codes by the bar code reader 5. The areas (2) and (24) represent start marks of the individual bar code lines (see FIG. 4). The area (3) is a rhythm data designation area (see FIG. 4). The area (4) represents rock as a kind of rhythm (see FIG. 5). The area (5) represents a quarter note specifying tempo (see FIG. 6). The area (6) represents tempo (72) in terms of BCD notation. The area (7) represents the pattern length, i.e., number of steps, of fill-in 1 shown in FIG. 9 (see FIG. 7). The areas (8) through (15) represent respective percussion instrument sounds successively set in the rhythm steps 1 to 8 in the fill-in 1 (see FIG. 9), namely base drum, blank, snare drum, blank, high conga, high conga, low conga and low conga in the mentioned order.

The area (16) represents the pattern length, i.e. number of steps 8, of fill-in 2 shown in FIG. 10. The areas (17) through (19) and (25) through (29) represent respective percussion instrument sounds successively set in rhythm steps 1 to 8 in fill-in 2 (see FIG. 10), namely bass drum and low conga, low conga, high conga, high conga, tam-tam, tam-tam, cymbal and blank.

The area (20) constitutes an end mark representing the end of the first bar code line (see FIG. 4). The area (21) constitutes a continuation mark indicative of the fact that a next bar code line follows (see FIG. 4). The area (22) is a check-sum area for checking whether or not various data are correctly coupled.

The area (30) represents a fill-in end (see FIG. 7).

The areas (31) through (42) represent the contents of each measure in the progress of the music score of FIG. 12. More particularly, the area (31) represents normal (see FIG. 5). In this case, the normal is the rock. The area (32) has a meaning of specifying the rock rhythm for four measures. The area (33) represents a fill-in designation number 1 set for the next measure, i.e., the fifth measure (see FIG. 8). The area (34) represents normal. The area (35) has a meaning of specifying the rock rhythm for the succeeding four measures, i.e., the sixth to ninth measures. The area (36) represents the fill-in designation number 1 (see FIG. 8). The area (37) has a meaning of specifying variation (see FIG. 5). The area (38) has a meaning of designating variation rhythm performance for the succeeding eight measures, i.e., the eleventh to eighteenth measures. The area (39) represents the fill-in designation number 2 (see FIG. 8). The area (40) represents normal. The area (41) has a meaning of designating the rock rhythm for the succeeding four measures, i.e., the twentieth to twenty-third measures. The area (42) represents the fill-in designation number 2. The area (43) constitutes an end mark representing the end of the second bar code line (see FIG. 4).

The area (44) represents the termination of data with this line (see FIG. 4). The area (45) is a check-sum area for checking whether various data are correctly coupled.

The binary data or bar code data that is obtained in the above way is stored in the RAMs 29 and 30. More particularly, the contents of the fill-ins 1 and 2 are stored in the RAM 29, and the contents of the individual measures are stored in the RAM 30. The rhythm data may be written in the RAMs 29 and 30 by operating various switches in the operating section 1 instead of using the bar code reader 5. The details of the writing operation in this case are not described here.

By switching the first mode switch 8 to the "PLAY" position, automatic rhythm performance can be obtained according to the rhythm data stored in the RAMs 29 and 30 or rhythm data stored in the ROM 28. In this case, for the first through fourth measures in FIG. 12, a clock signal $f_1$ corresponding to the rock rhythm of tempo ♩ =(72) output from the oscillating circuit 27 with the signal from the CPU 24, is supplied to the gate G1, and this clock signal $f_1$ is output according to the control signal $t_1$. Here, the clock signal $f_1$ is entirely the same as the clock signal $f_0$. The clock signal $f_0$ on-off controls the switching gates 31*a* to 31*h*. The clock signal $f_1$, on the other hand, causes increment operation of the address counter 25.

The gate G2 is enabled by the control signal $t_1$ to transfer data from the ROM 28 to the switching gates 31*a* to 31h. The gate G3, on the other hand, remains disabled to cut off the data from the RAM 29.

In the ROM 28 a rock rhythm pattern as shown in FIG. 13 is stored so that high-hat sound is produced for the first through eighth beats, snare drum sound for the third and seventh beats, and bass drum sound for the first, fourth, fifth and eighth beats. The address counter 25 is thus a scale of 82 counter. For the first beat, it causes a one-shot signal to be supplied to the high-hat sound source in the rhythm sound source 32*f* and also the bass drum sound source in the source 32*h* through the gate G2 and switching gates 31*f* and 31*h*. The outputs of these sound sources are coupled through the mixer 33 to the loudspeaker 2 for producing sound. For the second beat, a one-shot signal is supplied to the high-hat sound source in the rhythm sound source 32*f* through the switching gate 31*f* so that the high-hat sound is produced. Likewise, for the third beat the high-hat and snare drum sounds are produced. During this time, the ROM 28 is providing a signal for producing high-hat sound for one measure, and a one-shot signal is produced by the clock signal $f_0$ and supplied to the high-hat sound source of the rhythm sound source 32*f*.

For the fifth measure, the clock signal $f_0$ for producing the rhythm pattern of fill-in 1 shown in FIG. 9, is produced from the oscillating circuit 27 and supplied to the gate G1. The gate G1 provides the clock signal $f_2$ under the control of the control signal $t_2$ from the CPU 24. The clock signal $f_2$ is the same as the clock signal $f_0$. The address counter 26 is a scale of 82 counter to cause the RAM 29 to be incremented according to the clock signal $f_2$. Further, the CPU 24 provides an address signal that specifies the area where the fill-in 1 data is stored. Thus, like the operation for the first through fourth measures, the bass drum sound is produced for the first beat, silence for the second, snare drum sound for the third and so forth. In this way, rhythm performance for the fifth measure is obtained according to the data from the RAM 30.

Rhythm performance of the content shown in FIG. 12 is thus effected in the above operation. For the normal rhythm the rhythm sound sources 32*a* to 32*h* are driven according to the output of the ROM 28, while for the fill-in rhythm the rhythm sound sources 32*a* to 32*h* are driven according to the output of the RAM 29.

The bar codes may be based on the well known coding system such as FM, RZ, NRZ, NRZI, PE or MFM coding system or any other suitable coding system. The form of the bar codes is also not limited to the one in the above embodiment.

Further, while in the above embodiment the bar code reader used has been a hand scanner, it is also possible to use a bar code reader for automatically reading bar codes. Also, the method of bar code reading in the above embodiment is not limitative.

Moreover, the bar code reader need not be permanently connected to the rhythm box via a chord, and it may be removably mounted on the rhythm box, for instance by a pin-and-jack system. In this case, the bar code reader may be mounted on the rhythm box body only when it is used, which is very convenient from the standpoint of accommodation of the rhythm box.

Further, any desired number of different rhythms may be set, and the invention may be incorporated in an electronic keyboard musical instrument instead of the rhythm box.

As has been described in the foregoing, according to the invention, use is made of a bar code reader for reading out bar codes representing predetermined rhythm data from a medium on which the bar codes are recorded, and rhythm data is set by writing the rhythm data read out with the bar code reader, in a memory. Thus, it is possible to set rhythm data in a short period of time and very easily. The operability can thus be extremely improved. Further, unlike the case of setting data by switch operation, no particular skill is required for operation, and even beginners can easily set rhythm data. Also, the recording medium may be an ordinary paper sheet on which bar codes may be recorded by printing. Thus, compared to magnetic cards, magnetic tapes or semiconductor memories, the cost can be greatly reduced while also increasing the recording capacity. The invention is thus very beneficial in practice.

What is claimed is:

1. A rhythm data setting system for an electronic musical instrument, comprising:

a bar code reader for reading out bar codes representing rhythm pattern data recorded on a recording medium;

memory means arranged to be coupled to said bar code reader for digitally storing the rhythm pattern data read out by said bar code reader;

reading means coupled to said memory means for reading out the stored rhythm pattern data; and producing means associated with said reading means for generating a rhythm performance wherein the pattern of the rhythm is determined by the rhythm pattern data read out by said reading means.

2. The rhythm data setting system according to claim 1, including a musical score forming the recording medium, and wherein bar codes are provided on the recording medium in corresponding relation to the musical score.

3. The rhythm data setting system according to claim 1, wherein said bar code reader comprises a hand scanner including a photoreflector provided at a tip of said hand scanner, a light-emitting element, and a light-receiving element.

4. The rhythm data setting system according to claim 1, wherein said memory means includes a random access memory for storing the rhythm pattern data read out by said bar code reader.

5. The rhythm data setting system according to claim 4, wherein said reading means includes a CPU for supplying address data to said random access memory to enable the read out of the stored rhythm pattern data from said random access memory.

6. A rhythm data setting system for an electronic musical instrument, comprising:

a bar code reader for reading out bar codes representing rhythm progression data recorded on a recording medium;

memory means arranged to be coupled to said bar code reader for digitally storing the rhythm progression data read out by said bar code reader;

reading means coupled to said memory means for reading out the stored rhythm progression data; and producing means associated with said reading means for generating a rhythm performance wherein the progression of the rhythm is determined by the rhythm progression data read out by reading means.

7. The rhythm data setting system according to claim 6, including a musical score forming the recording medium, and wherein bar codes are provided on the recording medium in corresponding relation to the musical score.

8. The rhythm data setting system according to claim 1, wherein said bar code reader comprises a hand scanner including a photoreflector provided at a tip of said hand scanner, a light-emitting element, and a light-receiving element.

9. The rhythm data setting system according to claim 6, wherein said memory means includes a random access memory for storing the rhythm progression data read out by said bar code reader.

10. The rhythm data setting system according to claim 9 wherein said reading means includes a CPU for supplying address data to said random access memory to enable the read out of the stored rhythm progression data from said random access memory.

11. A rhythm data setting system for an electronic musical instrument, comprising:

a bar code reader for reading out bar codes representing data which indicates a particular kind of rhythm recorded on a recording medium;

memory means arranged to be coupled to said bar code reader for digitally storing the data indicating said kind of rhythm as read out by said bar code reader;

reading means coupled to said memory means for reading out the stored data indicating said kind of rhythm; and producing means associated with said reading means for generating a rhythm performance wherein the particular kind of rhythm is determined by the kind of rhythm data read out by said reading means.

12. The rhythm data setting system according to claim 1, including a musical score forming the recording medium, and wherein bar codes are provided on the recording medium in corresponding relation to the musical score.

13. The rhythm data setting system according to claim 11, wherein said bar code reader comprises a hand scanner including a photoreflector provided at a tip of said hand scanner, a light-emitting element, and a light-receiving element.

14. The rhythm data setting system according to claim 11, wherein said memory means includes a random access memory for storing the data which indicates the kind of rhythm, as read out by said bar code reader.

15. The rhythm data setting system according to claim 11, wherein said reading means includes a CPU for supplying address data to said random access memory to enable the read out of the stored data which indicates the kind of rhythm, from said random access memory.

16. A rhythm data setting system for an electronic musical instrument, comprising:

first memory means for storing at least one of a number of different preset rhythm data;

a bar code reader for reading out bar codes representing rhythm data recorded on a recording medium;

second memory means arranged to be coupled to said bar code reader for digitally storing the rhythm data read out by said bar code reader;

reading means coupled to said first and said second memory means for reading out selectively the preset rhythm data stored in said first memory means and the rhythm data stored in said second memory means; and producing means associated with said reading means for generating a rhythm performance wherein said reading means reads out data, from a selected one of said first and said second memory means in accordance with the rhythm data read out by said bar code reader.

17. A rhythm data setting system for an electronic musical instrument according to claim 16, wherein said producing means is arranged to generate the rhythm performance in accordance with rhythm data read out by said bar code reader, said rhythm data corresponding to at least one of a rhythm pattern, a rhythm progression, and a particular kind of rhythm to be generated.

* * * * *

UNITED STATES PATENT AND TRADEMARK OFFICE

CERTIFICATE OF CORRECTION

PATENT NO. : 4,464,966

DATED : August 14, 1984

INVENTOR(S) : Hideaki ISHIDA

It is certified that error appears in the above-identified patent and that said Letters Patent is hereby corrected as shown below:

COLUMN 4, line 46, after "specifying the" change line to read --normal (i.e., the rock rhythm) performance --;

COLUMN 4, line 51, change line to read --normal (i.e., the rock rhythm) performance--;

COLUMN 4, line 60, change line to read --of designating the normal (i.e., rock rhythm) performance for the succeeding four--;

COLUMN 8, line 44, after "read out data"delete ","

Signed and Sealed this

*Twenty-third* Day of *April 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,464,966

DATED : August 14, 1984

INVENTOR(S) : Hideaki ISHIDA

It is certified that error appears in the above-identified patent and that said Letters Patent is hereby corrected as shown below:

COLUMN 7, line 34 (claim 8), change "1" to --6--;

COLUMN 8, line 9 (claim 12), change "1" to --11--.

Signed and Sealed this

*Third* Day of *September 1985*

[SEAL]

*Attest:*

DONALD J. QUIGG

*Attesting Officer* *Acting Commissioner of Patents and Trademarks - Designate*